US006471146B1

(12) United States Patent
Kuykendal et al.

(10) Patent No.: US 6,471,146 B1
(45) Date of Patent: Oct. 29, 2002

(54) LAMINAR NOZZLE

(76) Inventors: Robert L. Kuykendal, 4118 Harbor Town, High Ridge, MO (US) 63049; Ronald S. Deichmann, 4997 Dover La., House Springs, MO (US) 63051

( * ) Notice: Subject to any disclaimer, the term of this patent is extended or adjusted under 35 U.S.C. 154(b) by 0 days.

(21) Appl. No.: 09/813,140

(22) Filed: Mar. 21, 2001

(51) Int. Cl.[7] ..... B05B 1/00

(52) U.S. Cl. ..... 239/589; 239/523; 239/524; 239/16; 239/17; 239/590; 239/590.3

(58) Field of Search ..... 239/16, 17, 523, 239/524, 462, 575, 589, 590, 590.3, DIG. 23

(56) References Cited

U.S. PATENT DOCUMENTS 2,873,142 A * 2/1959 Zetterström ..... 239/590.3
3,630,444 A * 12/1971 Nelson ..... 239/590.3
4,343,435 A * 8/1982 Anderton et al. ..... 239/590.3
4,795,092 A * 1/1989 Fuller ..... 239/462
5,213,260 A * 5/1993 Tonkinson ..... 239/590.3
5,641,120 A * 6/1997 Kuykendal et al. ..... 239/18

* cited by examiner

*Primary Examiner*—Robin O. Evans
(74) *Attorney, Agent, or Firm*—Henry W. Cummings

(57) ABSTRACT

In FIG. 1, turbulent water or other fluid enters the nozzle body, 2, at inlet port, 1, and encounters the convex surface of a porous filter which has been formed into the shape of a hollow hemisphere, 3, at the center of which is the exit orifice. As the fluid flows through the hollow hemispherical diffuser it has its Reynold's Number significantly reduced. The energy of any gross turbulences on the convex side of the diffuser tends to be converted to a very great number of micro-turbulences which tend to be self canceling. Since the diffuser, 3, also shown in FIG. 3, is shaped as a hollow hemisphere centered upon the exit orifice, 4, then all water flowing from the diffuser to the exit orifice has substantially the same distance to travel from all directions. With this low-turbulence fluid all having substantially the same straight-line distance to travel to the exit orifice, 4, there tends to be little new turbulence introduced and the fluid, 5, exiting the orifice, 4, tends to be highly laminar.

8 Claims, 2 Drawing Sheets

LAMINAR NOZZLE

I. FIELD OF THE INVENTION

This invention discloses a new diffuser for reducing turbulence within laminar nozzles.

II. BACKGROUND OF THE INVENTION

U.S. Pat. No. 5,160,086 granted Nov. 3, 1992 is directed to alighted laminar flow nozzle for use in decorative water fountains and industrial applications. It includes fluid flow through a double-walled bladder-like fluid supply hose 32 into a fluid chamber 10 and through a diffuser material 20, past trapped air pockets 18 and exiting through a knife edged orifice 12. The fluid nozzle is mounted upon one or more stages of vibration dampening springs 30, and the outlet orifice 12 is located off center from the walls 11 of the fluid chamber so that pump surges and vibrations are greatly dampened and the output fluid stream 14 is sufficiently laminar that light is conducted through the length of the output fluid stream 14 similar to a fiber optic cable.

U.S. Pat. No. 5,641,120 granted Jun. 24, 1997 is an improvement on the first described patent 5,160,086. This patent 5,641,120 includes an improved method and apparatus for obtaining a laminar stream of fluid flow including providing a generally cylindrical outer wall 13*a*, a generally cylindrical inner wall 14 defining a generally cylindrical outer chamber 13; introducing fluid into the outer chamber 13 tangentially at 12, directing fluid flow within the outer chamber circumferentially through chamber 13; providing an inner chamber 36 defined by the generally cylindrical inner wall located within or below the outer chamber 13. An opening 33 is formed in the lower portion of the inner cylindrical wall 14, which causes fluid to flow downwardly through the opening 33 from the outer chamber 13 into the inner chamber 36. Located within the inner chamber is a diffuser material having a plurality of parallel fluid flow paths. Fluid is caused to flow through the diffuser material to dampen major currents of fluid velocity. The diffuser material to dampen major currents of fluid velocity. The diffuser material has an arcuate upper surface 84. Fluid is caused to flow radially inwardly from the arcuate surface through an orifice 20 located above the diffuser material to form a laminar fluid stream.

III. SUMMARY OF THE INVENTION

In FIG. 1, turbulent water or other fluid enters the nozzle body, 2, at inlet port, 1, and encounters the convex surface of a porous filter which has been formed into the shape of a hollow hemisphere, 3, at the center of which is the exit orifice. As the fluid flows through the hollow hemispherical diffuser it has its Reynold's Number significantly reduced. The energy of any gross turbulences on the convex side of the diffuser tends to be converted to a very great number of micro-turbulences which tend to be self canceling.

Since the diffuser, 3, also shown in FIG. 3, is shaped as a hollow hemisphere centered upon the exit orifice, 4, then all water flowing from the diffuser to the exit orifice has substantially the same distance to travel from all directions. With this low-turbulence fluid all having substantially the same straight-line distance to travel to the exit orifice, 4, there tends to be little new turbulence introduced and the fluid, 5, exiting the orifice, 4, tends to be highly laminar.

IV. THE DRAWINGS

V. DESCRIPTION OF PREFERRED EMBODIMENTS

This invention discloses a laminar nozzle, comprising a cylindrical nozzle body enclosure, 2, with an entry port at one end, 1, a location opposite the knife-edged exit orifice, 4, centered at the opposite end. Contained within said nozzle body, 2, is a hollow hemispherical means for diffusing 3, positioned such that the knife-edged exit orifice is at the center of the concave side 10 of the hollow hemispherical means for diffusing 3, and such that all fluid traversing from the inlet port, 1, to the exit orifice, 4, must travel through the means for diffusing, 3. The hemispherical means for diffusing 3, can be made, for example, of ¼ inch to 1 inch thick polyester fiber air filter material which has been heat formed over a hemispherical mandrel.

Figure 1:
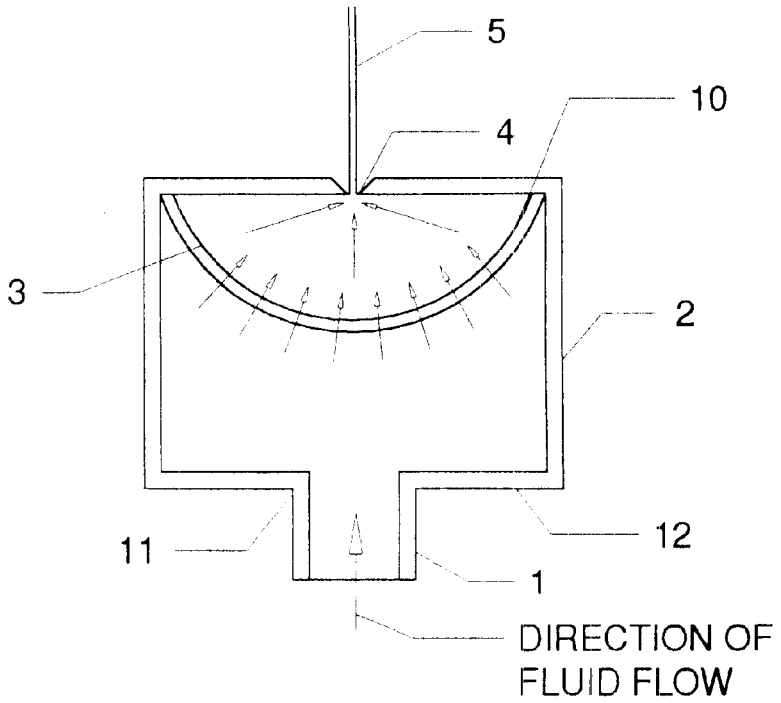
FIG. 1 is a schematic sectional view illustrating that substantially all the water flowing from the diffuser to the exit orifice travels substantially the same distance.
Figure 3:
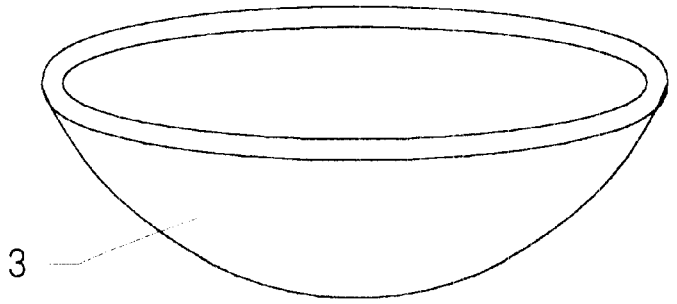
FIG. 3 is a perspective view of the improved diffuser of the present invention.
Figure 2:
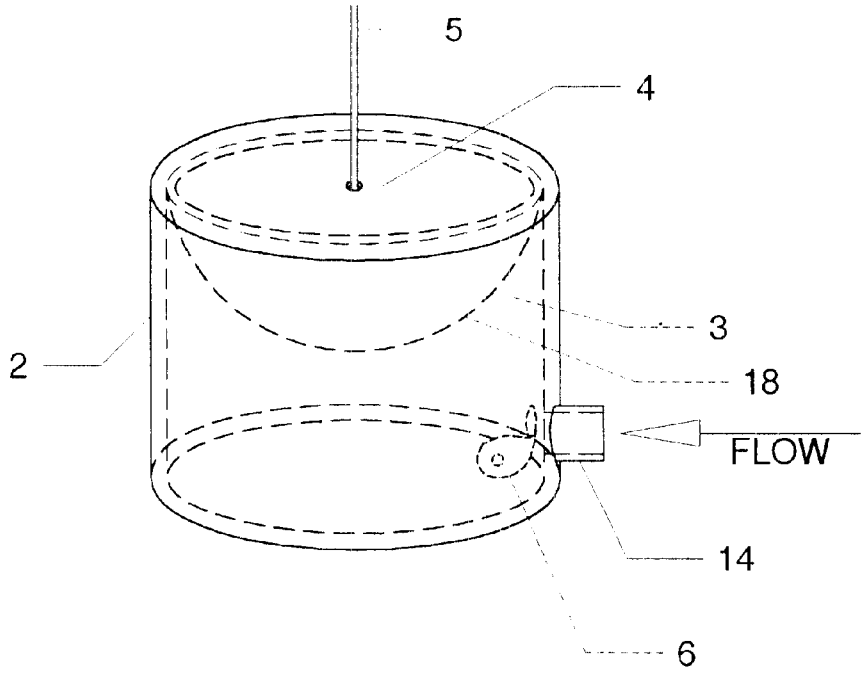
FIG. 2 is a perspective view of the improved nozzle assembly of the present invention.
Figure 4:
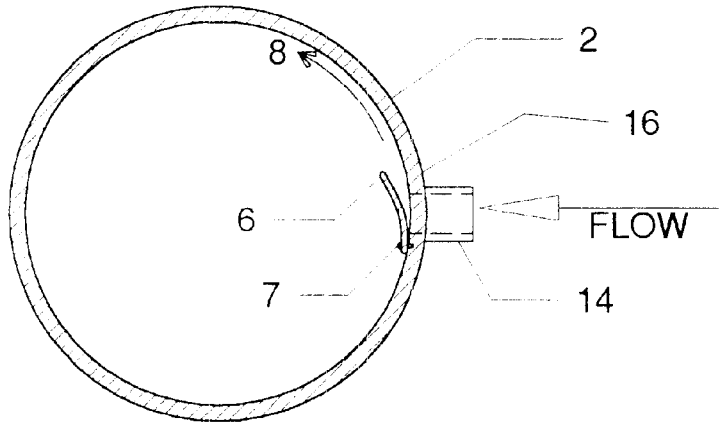
FIG. 4 is a plan view of the improved nozzle assembly of the present invention looking in the direction of the arrows along the line 4—4 in FIG. 2.

Another embodiment of the present invention shown in FIGS. 2 and 4, comprises the nozzle body, 2, diffuser, 3, exit orifice, 4. However, in this embodiment the inlet port, is moved from the center 11 of the end wall 12 to a location 14 to allow fluid to enter the nozzle body, 2, radially though the side wall 16 toward the end opposite from the exit orifice.

On the inside wall of the nozzle body, 2, there is affixed a blade, 6, for example with an attaching screw, 7, directly in front of the inlet port, 1, such that water entering through inlet port, 1, is forced to flow in the direction indicated by the arrow, 8, in a mild circular flow. This circular flow will tend to distribute water flow and turbulence evenly all over the convex side 18 of the hemispherical means for diffusing 3, and assuring that fluid will flow through evenly from all directions so that no large turbulances can be created on the concave side 10.

What is claimed is:

1. An improved laminar nozzle assembly comprising:

means for causing fluid to enter the nozzle assembly;

a diffuser located within said assembly;

said diffuser comprising a porous filter formed into a hollow hemisphere having a generally convex surface and a generally concave surface;

said generally concave having a center spaced from said generally convex surface;

an exit orifice spaced from said generally concave surface and located generally at said center, whereby as said fluid flows through said hollow hemispherical diffuser it has its Reynold's Number significantly reduced, and any turbulances on said convex surface tend to be converted to a very great number of micro-turbulances which tend to be self canceling and substantially all water flowing from the diffuser to the exit orifice has substantially the same distance to travel from substantially all directions, the fluid exiting said orifice is highly laminar.

2. An improved nozzle assembly according to claim 1 wherein said diffuser is made of polyester fiber air filter material.

3. An improved nozzle assembly according to claim 2 wherein said material is about ½ to 1 inch thick.

4. An improved nozzle assembly according to claim 2 wherein material has been heat formed over a hemispherical mandrel.

5. An improved laminar nozzle assembly comprising:

a generally cylindrical nozzle body having a exit orifice, a continuous wall and a end opposite from said exit orifice;

an inlet port for causing fluid to enter the nozzle assembly radially though said wall toward said end;

a diffuser located within said assembly;

said diffuser comprising a porous filter formed into a hollow hemisphere having a convex surface and a concave surface having a center;

an exit orifice located generally at said center;

a blade located on the inside of said wall directly in front of said inlet port, whereby water entering through said inlet port is forced to flow in a generally circular direction hereby said circular flow will tend to distribute water flow and turbulance evenly whereby as said fluid flows through said hollow hemispherical diffuser it has it Reynold's Number significantly reduced, and turbulances on said convex side of said diffuser tend to be converted to a large number of micro-turbulances which tend to be self canceling and substantially all water flowing from said diffuser to the exit orifice has substantially the same distance to travel from substantially all directions, and the fluid exiting said orifice is highly laminar.

6. An improved nozzle assembly according to claim 5 wherein said diffuser is made of polyester fiber air filter material.

7. An improved nozzle assembly according to claim 6 wherein material has been heat formed over a hemispherical mandrel.

8. An improved nozzle assembly according to claim 6 wherein said material is about ½ to 1 inch thick.

* * * * *